US009226605B1

(12) United States Patent
Castellano

(10) Patent No.: US 9,226,605 B1
(45) Date of Patent: Jan. 5, 2016

(54) PILLOW AND PILLOWCASE THEREFORE

(71) Applicant: David Castellano, East Setauket, NY (US)

(72) Inventor: David Castellano, East Setauket, NY (US)

( * ) Notice: Subject to any disclaimer, the term of this patent is extended or adjusted under 35 U.S.C. 154(b) by 0 days.

(21) Appl. No.: 14/678,845

(22) Filed: Apr. 3, 2015

(51) Int. Cl.
*A47G 9/10* (2006.01)
*A47G 9/02* (2006.01)

(52) U.S. Cl.
CPC ..... *A47G 9/10* (2013.01); *A47G 9/0253* (2013.01); *A47G 2009/1018* (2013.01)

(58) Field of Classification Search
CPC ..... A47G 9/10
USPC ..... 5/630, 636, 640, 646, 490
See application file for complete search history.

(56) References Cited

U.S. PATENT DOCUMENTS

D275,436 S 9/1984 Zierden
6,041,458 A * 3/2000 Vickers et al. ..... 5/636
D449,482 S 10/2001 Berke et al.
D449,483 S 10/2001 Berke et al.
D471,050 S 3/2003 Haubner
D484,727 S 1/2004 Haywood
D592,753 S 5/2009 Jacinto
D593,787 S 6/2009 Dafna
D598,230 S 8/2009 Huffman
D599,603 S 9/2009 Berland et al.
D711,159 S 8/2014 Castellano

* cited by examiner

*Primary Examiner* — Fredrick Conley
(74) *Attorney, Agent, or Firm* — QuickPatents; Kevin Prince

(57) ABSTRACT

A pillow for use by a person comprises a pillow body that has a front side, a rear side, and at least two opposing sides that together define an interior volume therewithin. A conduit traverses the interior volume between the two opposing sides and is adapted for receiving the person's arm therethrough. A cushy filler or foam material is disposed within the pillow body to substantially fill the internal volume thereof. A pillowcase includes a first open side through which the pillow body is inserted into a pillowcase interior space. A side of the pillowcase includes a pillowcase conduit extending away therefrom and that is aligned with the conduit of the pillow body when the pillow body is inserted into the pillowcase. An aperture traverses a side opposite the pillowcase conduit to which an end of the pillowcase conduit is fixed with a zipper or other fastener.

16 Claims, 4 Drawing Sheets

PILLOW AND PILLOWCASE THEREFORE

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to bedding, and more particularly to a pillow.

DISCUSSION OF RELATED ART

When sleeping while using a traditional pillow, and particularly when sleeping on one's stomach, people often find that the pillow migrates out of position over time. This can cause interruption of sleep due to discomfort of the person's head lying flat on the bed or on his arm. Further, often it is most comfortable for a person to sleep with his arm positioned under or very near his head, but with a pillow in the way this position is not easily achieved.

U.S. Design Pat. D275436 to Zierden on Sep. 11, 1984 teaches a pillowing having a looped strap affixed to one side thereof, which could be used to maintain the pillow on a person's arm. However, such a strap is uncomfortable when sleeping and tends to cut-off circulation to the arm as the pillow is twisted or repositioned.

U.S. Design Pat. D449,482 and D449,483 to Berke et al. on Mar. 12, 2001 teaches a device with an arm recess. Such a device may be more comfortable to use than a traditional pillow in that room is made for the person's arm under a portion of the pillow, but such a device is prone to being knocked or moved out of position as the person sleeps and moves his head. Further, such a device may only be used in one orientation, which can cause the pillow to wear unevenly. U.S. Design Pat. D471,050 to Haubner on Mar. 4, 2003 and D484,727 to Haywood on Oct. 11, 2002 both have similar drawbacks.

U.S. Design Pat. D593,787 to Dafna on Jun. 9, 2009 teaches a pillow having an arm sleeve fixed on one side. Such a product is principally designed for nursing an infant, but if made in a larger size could conceivably be used by an adult. Such a product would allow the pillow to be kept in place during use if the sleeping person extends his arm through the arm sleeve, but is again only useable on one side of the pillow, resulting in uneven wear. Such a device is also difficult to use with a pillowcase.

Therefore, there is a need for a pillow invention that provides a means for holding the pillow in place while a person sleeps. Such a needed device would also allow the person's arm to be positioned under his head while using the pillow. Such a needed invention would be usable on both a front and rear side for balancing wear on the pillow, and would be useable with a washable pillowcase. The present invention accomplishes these objectives.

SUMMARY OF THE INVENTION

The present invention is a pillow for use by a person, typically while sleeping on a bed or other horizontal surface. The pillow comprises a pillow body having a flexible outer covering that has a front side, a rear side, and at least two opposing sides that together define an interior volume therewithin. A flexible conduit traverses the interior volume between the two opposing sides and is adapted for receiving the person's arm therethrough. A cushy filler is disposed within the covering and about the conduit to substantially fill the internal volume of the pillow body.

Preferably the pillow includes a pillowcase that has a first open side through which the pillow body is inserted into a pillowcase interior space. A side of the pillowcase includes a pillowcase conduit extending away therefrom and that is aligned with the conduit of the pillow body when the pillow body is inserted into the pillowcase. The pillowcase preferably includes an aperture traversing a side opposite the pillowcase conduit to which an end of the pillowcase conduit extends when fixed within the conduit of the pillow body. The aperture may include a collar that overlaps the end of the pillowcase conduit when the pillowcase conduit is fixed within the conduit of the pillow body. A fastener, such as a zipper, may be included proximate the end of the pillowcase conduit for selectively fastening the pillowcase conduit to the collar of the aperture, or just to the aperture in the embodiment having no collar.

The present invention is a pillow that provides a means for holding the pillow in place while a person sleeps. The present device allows the person's arm to be positioned under his head while using the pillow, and is usable on both a front and rear side for balancing wear on the pillow. The present invention is also useable with a washable pillowcase. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
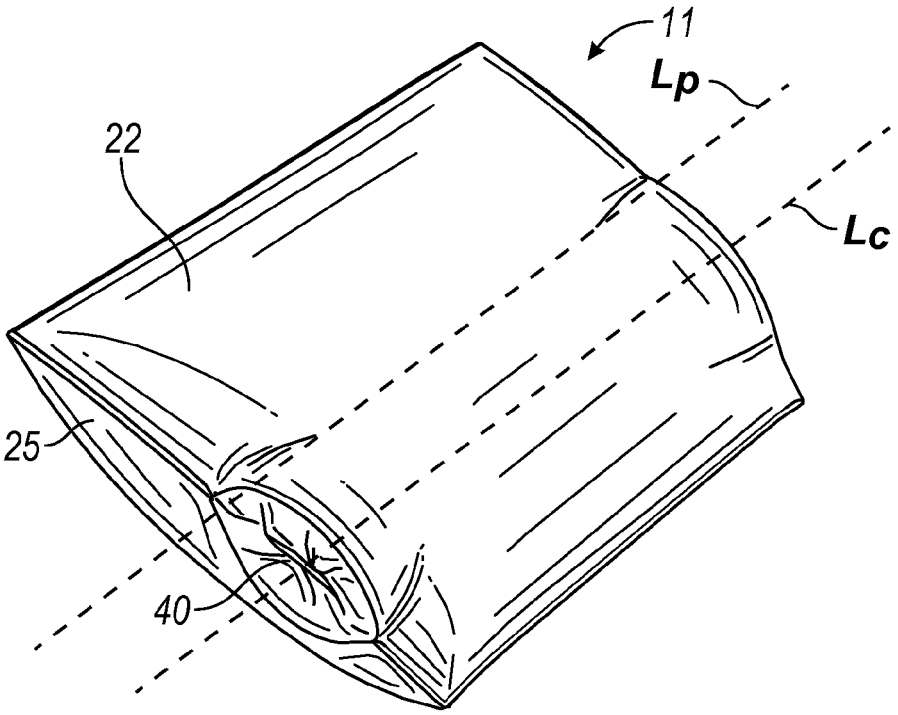
FIG. 1 is a perspective view of a pillow of the invention.
Figure 2:
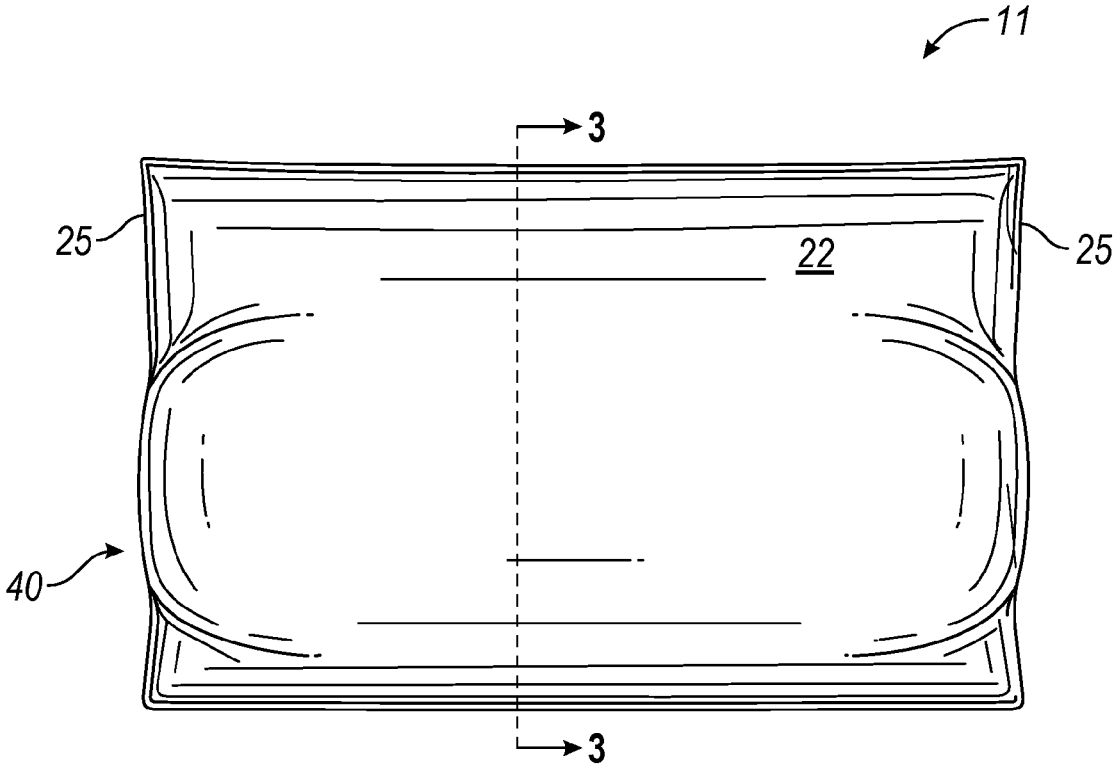
FIG. 2 is a top plan view of the invention.
Figure 3A:
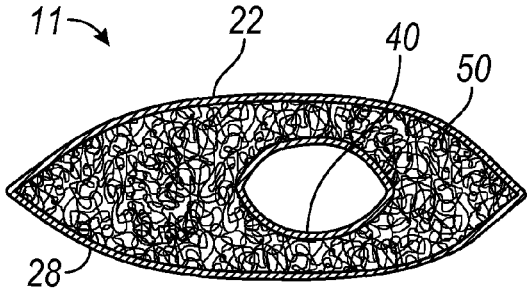
FIG. 3A is a cross-sectional view of one embodiment of the invention, taken along line 3-3 of FIG. 2.

FIGS. 1 and 2 illustrate a pillow 10 for use by a person, typically sleeping on a bed or other horizontal surface. The pillow 10 comprises a pillow body 11 having a flexible outer covering 20 that has a front side 22, a rear side 28, and at least two opposing sides 25 that together define an interior volume 30 therewithin (FIG. 3A). The covering 20 is preferably made with a flexible fabric, such as silk, cotton, woven or non-woven fabric, made with natural or synthetic fibers, or a combination thereof, or the like.

Figure 3B:
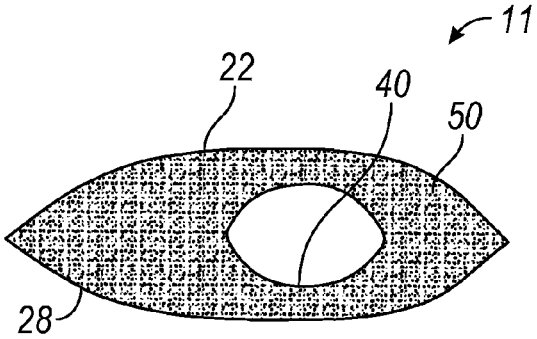
FIG. 3B is a cross-sectional view of a foam embodiment of the invention, taken along line 3-3 of FIG. 2.
Figure 4:
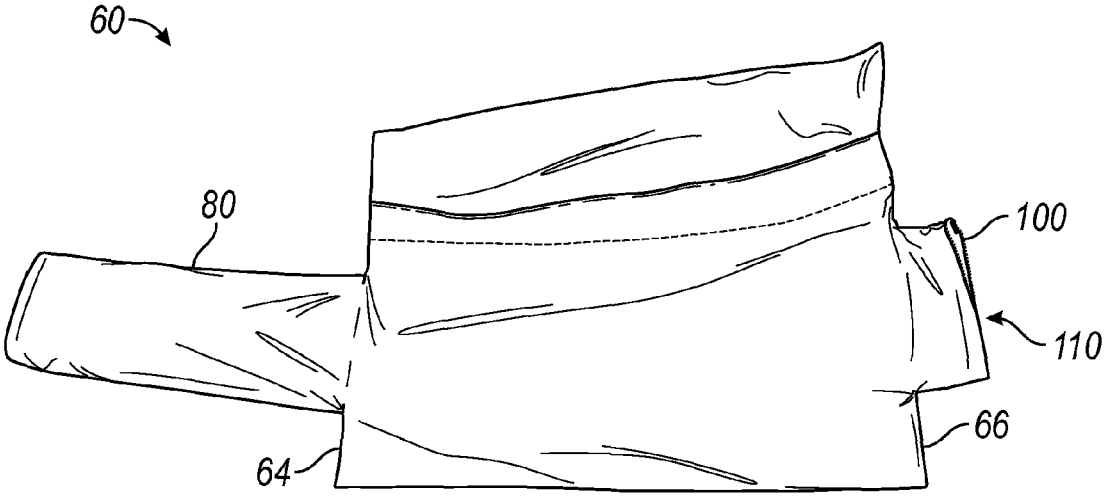
FIG. 4 is a perspective view of one embodiment of a pillowcase of the invention.
Figure 5:
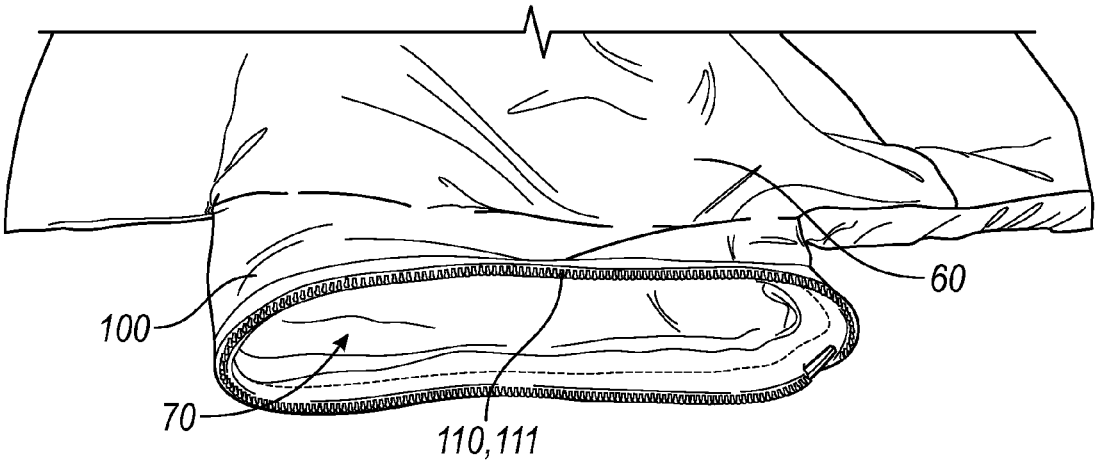
FIG. 5 is a an enlarged view of a pillowcase collar and fastening mechanism of one embodiment of the invention.
Figure 6:
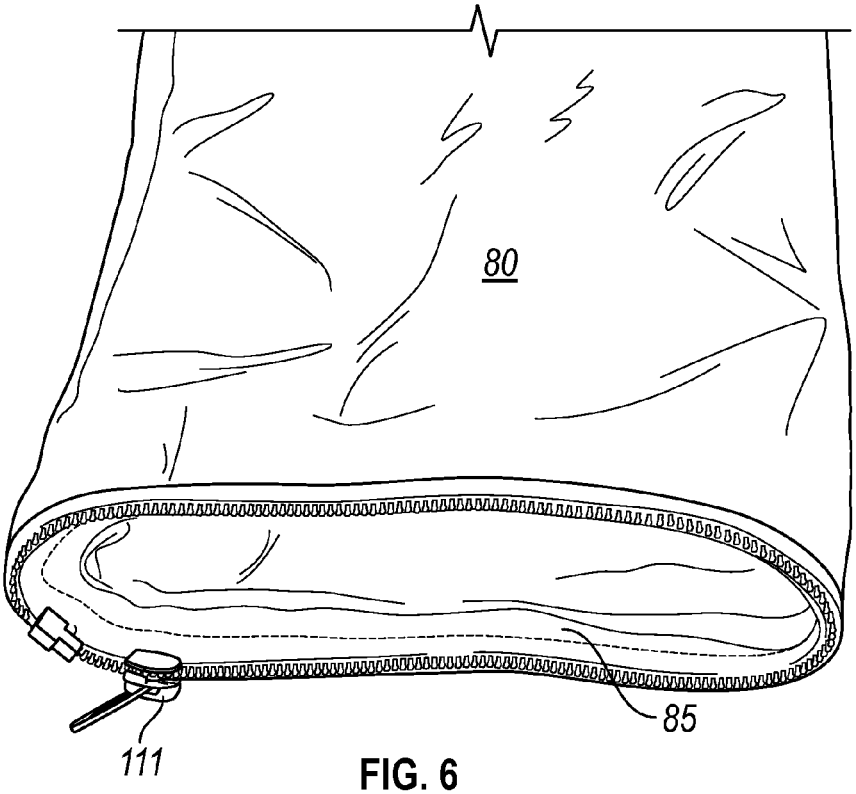
FIG. 6 is an enlarged view of a pillowcase conduit end and fastening mechanism of one embodiment of the invention.
Figure 7:
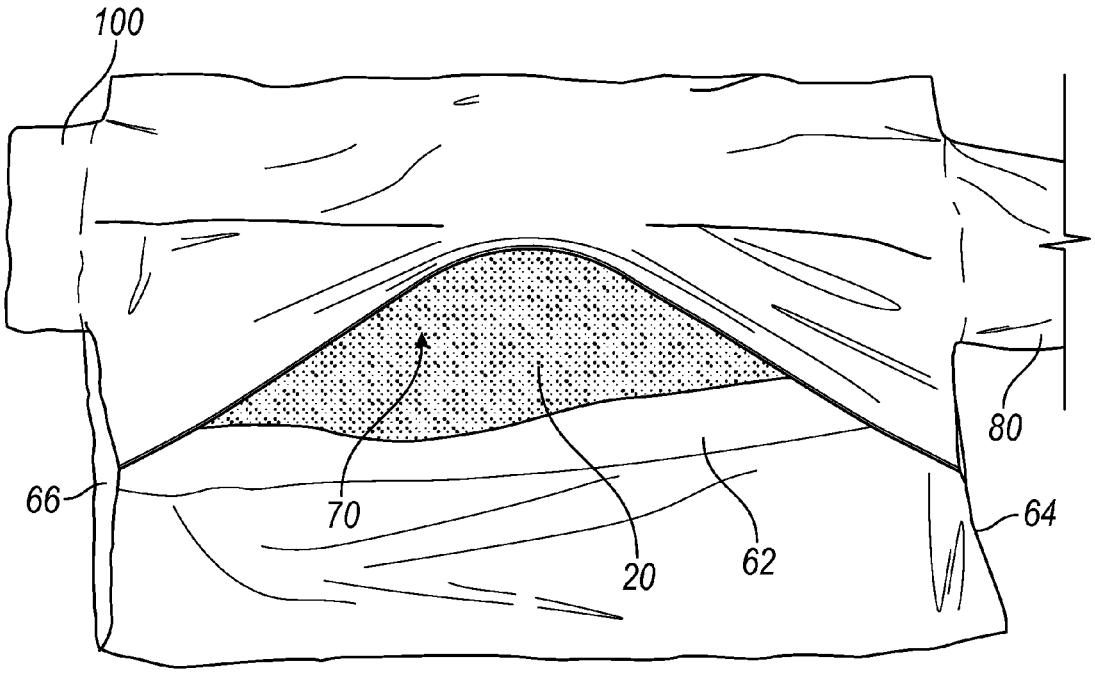
FIG. 7 is a partial perspective view of a pillow body inserted into one embodiment of a pillowcase of the invention.
Figure 8:
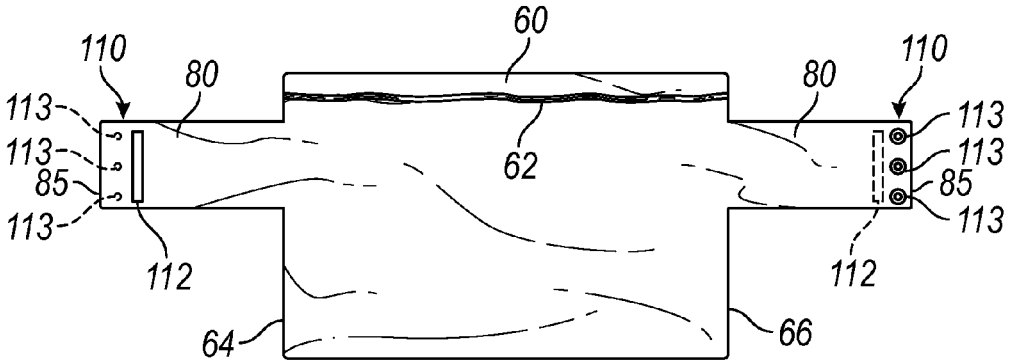
FIG. 8 is a top plan view of an alternate embodiment of the pillowcase.

In an alternate embodiment of the invention, the pillow body 11 is integrally formed with a foam material, such as either an open-cell or closed-cell foam, memory foam, or the like (FIG. 3B). In such an embodiment, the pillow body 11 does not include the flexible outer covering 20.

A conduit 40 traverses the interior volume 30 between the two opposing sides 25 and is adapted for receiving the person's arm (not shown) therethrough. Preferably the conduit 40 is made from a flexible fabric material such as that of the covering 20, or other flexible web as desired by the manufacturer. Preferably a longitudinal axis of the conduit $L_c$ is offset and parallel with a longitudinal axis of the pillow body $L_p$ (FIG. 1).

In the embodiment of FIG. 3A, a cushy filler 50 such as polyester filling, bamboo fibers, down, or the like, is disposed within the covering 20 and about the conduit 40 to substantially fill the internal volume 30 of the pillow body 11.

Preferably the pillow 10 includes a pillowcase 60 (FIGS. 4-8) that has a first open side 62 through which the pillow body 11 is inserted into a pillowcase interior space 70. A side 64 of the pillowcase 60 includes a pillowcase conduit 80 extending away therefrom and that is aligned with the conduit 40 of the pillow body 11 when the pillow body 11 is inserted into the pillowcase 60. The pillowcase 60 is preferably made using a flexible fabric, such as silk, cotton, woven or non-woven fabric, made with natural or synthetic fibers, or a combination thereof, or the like.

The pillowcase 60 preferably includes an aperture 90 traversing a side 66 opposite the pillowcase conduit 80 (FIGS. 5 and 8) to which an end 85 of the pillowcase conduit 80 extends when fixed within the conduit 40 of the pillow body 11. The aperture 90 may include a collar 100 that overlaps the end 85 of the pillowcase conduit 80 when the pillowcase conduit 80 is fixed within the conduit 40 of the pillow body 11. A fastener 110 may be included proximate the end 85 of the pillowcase conduit 80 for selectively fastening the pillowcase conduit 80 to the collar 100 of the aperture 90, or just to the aperture 90 in the embodiment having no collar 100. Such a fastener 110 may be a two-part mechanical fastener such as a zipper 111, a pair of hook-and-loop type fastening materials 112, a two-part mechanical snap fastener 113, or the like.

In one embodiment, instead of the pillowcase 60 having a relatively long conduit 80 and a relatively short collar 100, a pair of essentially equally-sized conduits 80 may be included (FIG. 8) that each extend partially into the conduit 40 of the pillow body 11. The fastener 110 may, as with other embodiments, include the zipper 111, the hook-and-loop type fastening material 112, the two-part mechanical snap fastener 113, or the like.

The pillowcase 60 has a sewing pattern (not shown) similar to that of the pillow covering 20, and in fact can be substantially identical except that the conduit 40 extending from one of the sides 25 is preferably sewn to the opposing side 25, and the pillowcase 60 pattern may be a bit larger than the pillow 10 pattern of the embodiment of FIG. 3A.

While a particular form of the invention has been illustrated and described, it will be apparent that various modifications can be made without departing from the spirit and scope of the invention. For example, a generally rectangular pillow 10 and pillowcase 60 are illustrated in the figures. However, other shapes may be used, such as circular, oval, square, and so forth. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A pillow for a person, comprising:

a pillow body having an outer covering having a front side, a rear side, and at least two opposing sides, the covering defining an interior volume therein;

a conduit traversing the interior volume between the two opposing sides, the conduit adapted for receiving the person's arm therethrough;

a cushy filler disposed within the cover and about the conduit;

a pillowcase having a first open side through which the pillow body is inserted into a pillowcase interior space, a side of the pillowcase including a conduit extending away therefrom and aligned with the conduit of the pillow body when the pillow body is inserted into the pillow case, whereby the conduit of the pillowcase is turned inside-out as it is pushed into the conduit of the pillow body.

2. The pillow of claim 1 wherein the pillowcase includes an aperture traversing a side opposite the pillowcase conduit to which an end of the pillowcase conduit extends when fixed within the conduit of the pillow body.

3. The pillow claim 2 wherein the aperture includes a collar that overlaps the end of the pillowcase conduit when the pillowcase conduit is fixed within the conduit of the pillow body.

4. The pillow of claim 3 wherein the end of the pillowcase conduit includes a fastener for selectively fastening the pillowcase conduit to the collar of the aperture.

5. The pillow of claim 4 wherein the fastener includes at least one mechanical snap fastener.

6. The pillow of claim 4 wherein the fastener includes a zipper.

7. The pillow of claim 4 wherein the fastener includes a hook-and-loop type material.

8. A pillow for a person, comprising:

a pillow body having an outer covering having a front side, a rear side, and at least two opposing sides, the covering defining an interior volume therein;

a conduit traversing the interior volume between the two opposing sides, the conduit adapted for receiving the person's arm therethrough;

a cushy filler disposed within the cover and about the conduit a pillowcase having a first open side through which the pillow body is inserted into a pillowcase interior space, two opposing sides of the pillowcase each including a conduit extending away therefrom and aligned with the conduit of the pillow body when the pillow body is inserted into the pillowcase, whereby each conduit of the pillowcase is turned inside-out as it is pushed into the conduit of the pillow body.

9. The pillow of claim 8 wherein the end of each pillowcase conduit includes a fastener for mutually and selectively fastening the pillowcase conduits within the conduit of the pillow body.

10. The pillow of claim 9 wherein each fastener includes at least one mechanical snap fastener.

11. The pillow of claim 9 wherein each fastener includes a zipper.

12. The pillow of claim 9 wherein each fastener includes a hook-and-loop type material.

13. A pillow for a person, comprising:

a pillow body having a front side, a rear side, and at least two opposing sides;

a conduit traversing the pillow body between the two opposing sides, the conduit adapted for receiving the person's arm therethrough;

a pillowcase having a first open side through which the pillow body is inserted into a pillowcase interior space, a side of the pillowcase including a conduit extending away therefrom and aligned with the conduit of the pillow body when the pillow body is inserted into the pillowcase;

whereby the conduit of the pillowcase is turned inside-out as it is pushed into the conduit of the pillow body.

14. The pillow of claim 13 wherein the pillowcase includes an aperture traversing a side opposite the pillowcase conduit to which an end of the pillowcase conduit extends when fixed within the conduit of the pillow body.

15. The pillow of claim 14 wherein the end of the pillowcase conduit includes a fastener for selectively fastening the pillowcase conduit to the aperture.

16. The pillow of claim 13 wherein a longitudinal axis of the conduit is offset and parallel with a longitudinal axis of the pillow body.

* * * * *